United States Patent [19]

Perlman

[11] Patent Number: 4,832,647

[45] Date of Patent: May 23, 1989

[54] HAT CLAPPER

[76] Inventor: Daniel Perlman, 94 Oakland Ave., Arlington, Mass. 02174

[21] Appl. No.: 197,701

[22] Filed: May 23, 1988

[51] Int. Cl.[4] ..... A63H 33/00; A63H 5/00

[52] U.S. Cl. ..... 446/27; 2/199; 40/329

[58] Field of Search ..... 446/27, 26, 28, 361, 446/362, 298, 81, 404, 418; 273/DIG. 17; D2/248, 250; 2/199, 185 R; 40/329

[56] References Cited

U.S. PATENT DOCUMENTS

| | | | |
|---|---|---|---|
| 1,618,517 | 2/1927 | Cureton | 446/27 |
| 1,619,007 | 3/1927 | Walsh | 40/329 |
| 1,800,775 | 4/1931 | Bostwick | 446/298 X |
| 3,705,466 | 12/1972 | Sela | 446/27 |
| 4,268,918 | 5/1981 | Lee | 446/27 X |
| 4,578,888 | 4/1986 | Gomez | 446/361 X |

*Primary Examiner*—Mickey Yu

*Attorney, Agent, or Firm*—Lorusso & Loud

[57] ABSTRACT

A hat for souvenir collectors or sports fans is disclosed. The hat has two hand extensions attached to the front brow. An elastic strip is attached to the front brow in a manner that pulls the hands together. A string which is looped under the chin is provided to pull the hands apart, rapid pulling and releasing of the string produces a clapping action. Attached to each hand is a noisemaking device. A flexible sheet is attached to the hands on which appears a printed slogan. The slogan can be read when the hands are pulled apart.

7 Claims, 1 Drawing Sheet

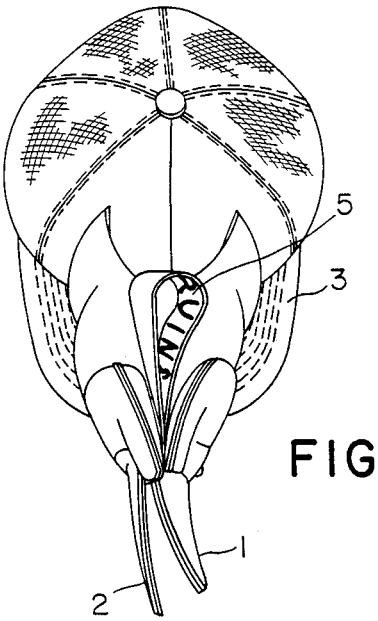
FIG. 1
FIG. 2
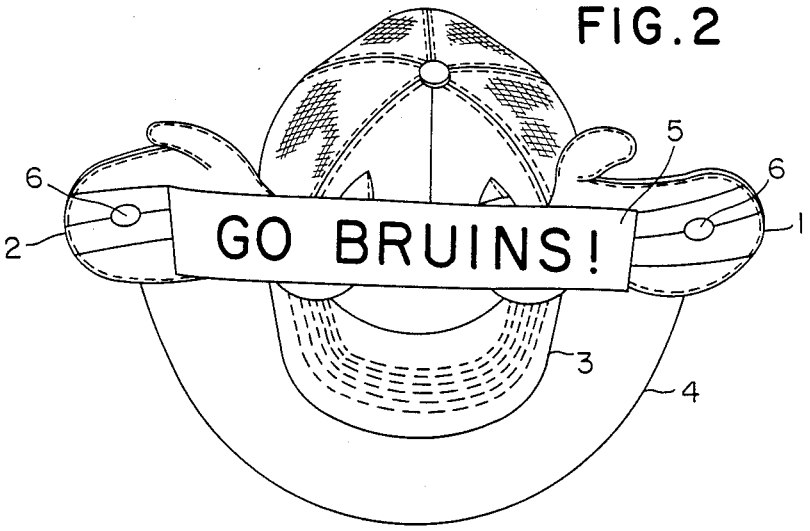

HAT CLAPPER

Headgear for souvenir collectors or enthusiastic sports fans is disclosed.

BACKGROUND OF THE INVENTION

This invention relates to souvenir hats for sports fans and novelty collectors. It allows sports fans to enthusiastically cheer for their team in a manner that is unusual and amusing yet neither obnoxious nor rude. It can be manufactured in any color imaginable and for any sports entity. Many slogans can be printed on a flexible sheet attached to a pair of hands which are, in turn, attached to the hat.

The invention consists of two appendages attached to the front brow of a hat or cap. In one embodiment the appendages are designed to resemble human hands with the palms of the hand facing each other. An elastic strip is attached to the hands in a manner that pulls the hands together in a closed position. A pull string is attached to the back of each of the hands and threaded through the sides of the hat, forming a loop under the hat wearer's chin. When this loop is pulled downward the hands are drawn apart, when the loop is released the elastic band pulls the hands together. Repeated pulling and releasing of the loop produces a clapping action. Attached to each hand is a cymbal or other like noisemaking device. A flexible sheet is attached to the heel of each hand, on the sheet is printed a suitable slogan such as "GO BRUINS". The printed slogan is visible when the hands are drawn apart. When the pull string is rapidly pulled and released the cymbals repeatedly strike each other producing a clapping sound. In addition, the slogan is flashed when the pull string is pulled and released, that is, the slogan is visible when the hands are open and not visible when the hands are closed. It is envisioned that this hat will be sold to booster clubs, avid fans and novelty collectors.

A more thorough understanding of the invention will be obtained from the following description of the preferred embodiments taken in conjunction with the accompanying drawings.

BRIEF DESCRIPTION OF THE DRAWINGS

FIG. 1 is a view of the hat with the hands in the closed position.

FIG. 2 is a view of the hat with the hands in the open position.

DETAILED DESCRIPTION OF THE PREFERRED EMBODIMENTS

Shown in FIGS. 1 and 2 is the hat clapper in the two positions, open and closed. There are two hands 1, 2 attached to the front brow 3 of the cap. These hands are drawn together by an elastic band (not visible) so that the palms touch one another. A filament string 4 is attached to the back of the hands and forms a loop worn under the wearer's chin. When the wearer pulls the loop downward the hands are pulled apart against the resistance of the elastic band. When the loop is released the elastic band pulls the hand back together. Repeated downward pulling and releasing of the loop produces a clapping action.

Attached to each palm is a flexible sheet onto which a suitable sports slogan 5 is printed. When the hands are in the open position (FIG. 2) the slogan is easily visible. Thus, the clapping action described above produces a flashing effect. This makes the slogan stand out in a crowd.

A further feature of the clapper hat is the addition of metal or plastic cymbals 6 attached to the each of the palms or the fingers. When the clapping motion is initiated the cymbals will strike each other producing a rhythmic noise. The noise resulting from the clapping action can be modified by the choice of materials used for the cymbals. Metal cymbals will produce a brighter sound while plastic cymbals will produce a sound similar to human hand claps.

While the foregoing invention has been described with reference to its preferred embodiments, it should not be limited to such embodiments since various alterations and modifications will occur to those skilled in the art. For example, the hands attached to the brow of the hat could be replaced by animal paws or fish fins. All such modifications and variations are intended to fall within the scope of the claims.

What I claim is:

1. A headgear comprising:

two appendages, each with an inner surface and an outer surface, said appendages are positioned so that the inner surfaces face each other;

an elastic strip attached to each of the appendages and holding the inner surfaces of said appendages together in a closed position;

a filament string attached to the outer surface of said appendages and forming a loop worn under the wearer's chin, such that when the wearer pulls the string downward, the appendages are pulled apart against the resistance of said elastic strip and when said string is released said appendages return to their closed position, thereby producing a clapping action;

a sheet of flexible material on which is printed a message, said sheet being attached to said appendages and parallel to said elastic strip and positioned between the inner surfaces of said appendages and being hidden from view when said appendages are in the closed position, and being open to view the appendages are in the open position.

2. A headgear comprising:

two appendages, each with an inner surface and an outer surface, said appendages are positioned so that the inner surfaces face each other;

an elastic strip attached to each of the appendages and holding the inner surfaces of said appendages together in a closed position;

a filament string attached to the outer surface of said appendages and forming a loop worn under the wearer's chin, such that when the wearer pulls the string downward, the appendages are pulled apart against the resistance of said elastic strip and when said string is released said appendages return to their closed position, thereby producing a clapping action;

strikers or cymbals as a noisemaking means inserted within or otherwise attached to the inner surfaces of said appendages such that the clapping action produces noise.

3. A headgear as set forth in claim 1 further comprising strikers or cymbals as a noisemaking means inserted within or otherwise attached to the inner surfaces of said appendages such that the clapping action produces noise.

4. A headgear as set forth in claim 3 wherein said appendages are in the shape of human hands with the inner surfaces corresponding to palms of a human hand.

5. A headgear as set forth in claim 3 wherein said appendages are in the shape of animal paws with the inner surfaces corresponding to pads of an animal paw.

6. A headgear as set forth in claim 3 wherein said appendages are in the shape of fish fins.

7. A headgear as set forth in claim 3 wherein said appendages are in the shape of lobster claws.

* * * * *